US010679806B2

(12) United States Patent
Campbell et al.

(10) Patent No.: US 10,679,806 B2
(45) **Date of Patent: *Jun. 9, 2020**

(54) COMPOSITE ARC SHIELDS FOR VACUUM INTERRUPTERS AND METHODS FOR FORMING SAME

(71) Applicant: EATON CORPORATION, Cleveland, OH (US)

(72) Inventors: Louis Grant Campbell, Elmira, NY (US); Eric Dennis Smith, Painted Post, NY (US); Franklin Willis Freeborn, Erin, NY (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 15/817,950

(22) Filed: Nov. 20, 2017

(65) Prior Publication Data

US 2018/0075991 A1 Mar. 15, 2018

Related U.S. Application Data

(62) Division of application No. 14/512,688, filed on Oct. 13, 2014, now Pat. No. 9,875,869.

(51) Int. Cl.
*H01H 33/662* (2006.01)
*H01H 11/00* (2006.01)

(52) U.S. Cl.
CPC ..... *H01H 33/66207* (2013.01); *H01H 11/00* (2013.01); *H01H 33/66261* (2013.01);
(Continued)

(58) Field of Classification Search
CPC ..... H01H 33/66207; H01H 33/66261; H01H 2033/66269; H01H 2033/66284; H01H 11/06; H05K 999/99
(Continued)

(56) References Cited

U.S. PATENT DOCUMENTS 3,355,564 A 11/1967 Ranheim
3,668,350 A 6/1972 Takeuchi et al.
(Continued)

FOREIGN PATENT DOCUMENTS

EP 0138478 A2 4/1985
EP 2618355 A1 7/2013
(Continued)

OTHER PUBLICATIONS

European Patent Office, extended European search report for corresponding application EP 15 18 9347.6, dated Apr. 13, 2016, 9 pages.
(Continued)

*Primary Examiner* — William A Bolton
(74) *Attorney, Agent, or Firm* — Eckert Seamans Cherin & Mellott, LLC

(57) ABSTRACT

The disclosed concept pertains to vacuum interrupters and arc-resistant shields. The arc-resistant shields are positioned in between a ceramic insulator. Each end of the arc-resistant shield is hermetically sealed to the ceramic insulator. The arc-resistant shield includes an outer surface and an inner surface. The inner surface includes an arc-resistant material. Disposed within the arc-resistant shield is a pair of electrode assemblies which are separable to establish arcing. In certain embodiments, the arc-resistant material is copper-chromium alloy.

9 Claims, 2 Drawing Sheets

(52) U.S. Cl.
CPC ..... *H01H 2033/66223* (2013.01); *H01H 2033/66269* (2013.01)

(58) Field of Classification Search
USPC ..... 218/136, 134, 147, 155; 29/622, 620
See application file for complete search history.

(56) References Cited

U.S. PATENT DOCUMENTS

| | | | | |
|---|---|---|---|---|
| 3,889,080 | A * | 6/1975 | Emmerich | H01H 33/66261 218/136 |
| 3,913,047 | A | 10/1975 | Arthur et al. | |
| 4,020,304 | A | 4/1977 | Cherry | |
| 4,553,007 | A | 11/1985 | Wayland | |
| 4,574,169 | A * | 3/1986 | Santilli | H01H 33/66261 218/136 |
| 4,665,287 | A * | 5/1987 | Sofianek | H01H 33/66261 218/136 |
| 5,120,918 | A | 6/1992 | Thomas et al. | |
| 5,438,174 | A | 8/1995 | Slade | |
| 7,758,917 | B2 | 7/2010 | Gentsch et al. | |
| 9,368,301 | B2 | 6/2016 | Campbell et al. | |
| 2007/0007250 | A1 | 1/2007 | Li | |
| 2007/0086909 | A1 * | 4/2007 | Abenthung | C23C 14/3414 419/29 |
| 2007/0196570 | A1 | 8/2007 | Gentsch et al. | |

FOREIGN PATENT DOCUMENTS

| | | | |
|---|---|---|---|
| GB | 2312788 | A | 11/1997 |
| JP | SHO 47-023199 | | 7/1972 |
| JP | S51-40568 | | 4/1976 |
| JP | SHO 60-095817 | | 5/1985 |
| WO | 0197242 | A1 | 12/2001 |
| WO | 2006032522 | A1 | 3/2006 |

OTHER PUBLICATIONS

Japanese Patent Office, Notice of Reasons for Rejection(JP 2015-175702, English Translation Summary also attached), dated Oct. 8, 2019, 10 pp.

* cited by examiner

COMPOSITE ARC SHIELDS FOR VACUUM INTERRUPTERS AND METHODS FOR FORMING SAME

CROSS-REFERENCE TO RELATED APPLICATION

This application claims priority from and claims the benefit of U.S. patent application Ser. No. 14/512,688, filed Oct. 13, 2014, which is incorporated by reference herein.

BACKGROUND

Field

The disclosed concept pertains generally to vacuum circuit breakers and other types of vacuum switchgear and related components, such as vacuum interrupters and arc-resistant shields. In particular, the disclosed concept pertains to a shield structure including an arc-resistant material which is hermetically sealed to a ceramic substrate of a vacuum interrupter, such as used in a vacuum circuit breaker.

Background Information

Vacuum interrupters are typically used to interrupt high voltage AC currents. The interrupters include a generally cylindrical vacuum envelope surrounding a pair of coaxially aligned separable contact assemblies having opposing contact surfaces. The contact surfaces abut one another in a closed circuit position and are separated to open the circuit. Each electrode assembly is connected to a current carrying terminal post extending outside the vacuum envelope and connecting to an AC circuit.

An arc is typically formed between the contact surfaces when the contacts are moved apart to the open circuit position. The arcing continues until the current is interrupted. Metal from the contacts that is vaporized by the arc forms a neutral plasma during arcing and condenses back onto the contacts and also onto a vapor condensing shield placed between the contact assemblies and the vacuum envelope after the current is extinguished.

The vacuum envelope of the interrupter generally includes a ceramic tubular insulating casing with a metal end cap or seal covering each end. The electrodes of the vacuum interrupter extend through the end caps into the vacuum envelope. At least one of the end caps is rigidly connected to the electrode and must be able to withstand relatively high dynamic forces during operation of the interrupter.

Various designs of interrupters are known in the art. There are full ceramic designs wherein the tubular insulating casing is composed completely of ceramic material. There is also known a design which includes a center portion composed of a metal shield with a ceramic portion located on both ends of the metal shield. This design is commonly referred to as a "belly band" interrupter.

Vacuum interrupters are key components of vacuum-type switchgear. It is typical for interrupters for vacuum-type circuit breakers using transverse magnetic field contacts to include a vapor shield, e.g., internal arc shield or arc-resistant shield, that is resistant to heavy arcing to restrict the outward dissemination of the arc and preserve the high voltage withstand of the interrupter after breaking the fault current.

It is customary for the shield to be constructed of copper, stainless steel, copper-chromium alloy or a combination thereof. In some cases, the shield may be constructed of one material in the arcing area and a second material may be used for the remainder of the shield. The copper-chromium alloy material may be used for the highest fault current ratings because of its resistance to arc damage and its ability to hold off high voltages after the arcing has occurred. It is typical for the copper-chromium alloy to include about 10 to 25% by weight chromium and the balance copper.

It is an object of the disclosed concept to develop new arc shield designs, for example, which can accommodate large contacts employed to interrupt large currents. Further, it is an object of the invention to design an arc shield that can be hermetically sealed to a ceramic insulator positioned at both ends of a vacuum interrupter. It is believed that such positioning of the shield provides available space for large contacts to be used as compared to an arc shield mounted fully inside of a fully ceramic insulating casing of a vacuum interrupter.

SUMMARY

These needs and others are met by embodiments of the disclosed concept, which provide arc-resistant shields, methods of producing the shields and vacuum interrupters including the shields. In an aspect, the disclosed concept provides an arc-resistant shield for a vacuum interrupter. The arc-resistant shield includes a shield structure having a first end, an opposite second end, an interior surface and an exterior surface; and an arc-resistant material present on the interior surface of the shield structure. The arc-resistant shield is positioned between a first ceramic insulator and a second ceramic insulator. The first end of the shield structure is hermetically sealed to the first ceramic insulator and the opposite second end of the shield structure is hermetically sealed to the second ceramic insulator. The arc-resistant shield defines an inner cavity. First and second electrode assemblies are disposed in said cavity and are separable to establish arcing.

The first and second ceramic insulators and the arc-resistant shield may be cylindrically shaped to form a tubular structure.

The vacuum interrupter can further include a first end seal connected to the first ceramic insulator and a second end seal connected to the second ceramic insulator.

The first ceramic insulator can have a first end and a second end, the first end of the first ceramic insulator positioned on the first end of the shield structure and the second end of the first ceramic insulator positioned on the first end seal of the vacuum interrupter. The second ceramic insulator can have a first end and a second end, the first end of the second ceramic insulator positioned on the opposite second end of the shield structure and the second end of the second ceramic insulator positioned on the second end seal of the vacuum interrupter. The first end of the shield structure is hermetically sealed to the first end of the first ceramic insulator and the second end of the shield structure is hermetically sealed to the first end of the second ceramic insulator.

The arc-resistant material can include copper-chromium alloy. The copper-chromium alloy can include from about 10 to about 60 weight percent chromium and balance copper based on total weight of the alloy.

The shield structure can be composed of a material selected from the group consisting of stainless steel, copper, steel, nickel-iron, cupronickel and mixtures thereof.

In certain embodiments, the arc-resistant material is co-formed within the shield structure. In other embodiments, the arc-resistant material is in a coating form and is deposited on the interior surface of the shield structure to form a layer thereon. In another aspect, the disclosed concept provides a vacuum interrupter which includes a tubular cavity defined by a first ceramic portion, a first end seal connected to the first ceramic portion, a second ceramic portion, a second end seal connected to the second ceramic portion, and an arc-resistant shield positioned between the first and second ceramic portions. The arc-resistant shield includes a shield structure having an interior surface, an exterior surface, a first end and an opposite second end; and an arc-resistant material present on at least a portion of the shield structure. The first end of the shield structure is hermetically sealed to the first ceramic portion and the opposite second end of the shield structure is hermetically sealed to the second ceramic portion. The vacuum interrupter further includes a first electrode assembly and a second electrode assembly. The first and second electrode assemblies are disposed within a portion of the cavity defined by the arc-resistant shield, said first and second electrode assemblies being separable to establish arcing.

In still another aspect, the disclosed concept provides a method for preparing a vacuum interrupter. The method includes forming a tubular vacuum cavity including a first ceramic portion, a second ceramic portion and an arc-resistant shield. The arc-resistant shield including a shield structure having an interior surface, an exterior surface, a first end and an opposite second end; and an arc-resistant material which is present on at least a portion of the interior surface of the shield structure. The tubular vacuum cavity further includes a first electrode assembly and a second electrode assembly. The method further includes positioning the arc-resistant shield between the first and second ceramic portions; hermetically sealing the first end of the shield structure to the first ceramic portion; hermetically sealing the opposite second end of the shield structure to the second ceramic portion; and positioning the first and second electrode assemblies within a portion of the cavity defined by the arc-resistant shield. The first and second electrode assemblies being separable to establish arcing.

The hermetically sealing can include brazing or welding.

In certain embodiments, the arc-resistant material is co-formed with the shield structure. For example, the arc-resistant material and shield structure can be co-formed against a mandrel utilizing a press selected from isostatic press and uniaxial press.

In other embodiments, the arc-resistant material is applied to the interior surface of the shield structure to form a layer thereon. For example, the arc-resistant material can be in a powder alloy form, mixed with a suitable binder to form a coating and the coating applied to the interior surface of the shield structure or the arc-resistant material in a powder alloy form can be mixed with a suitable binder to form a tape and the tape applied to the interior surface of the shield structure.

BRIEF DESCRIPTION OF DRAWINGS

A full understanding of the disclosed concept can be gained from the following description of the preferred embodiments when read in conjunction with the accompanying drawing in which.

DETAILED DESCRIPTION OF PREFERRED EMBODIMENTS

Figure 1:
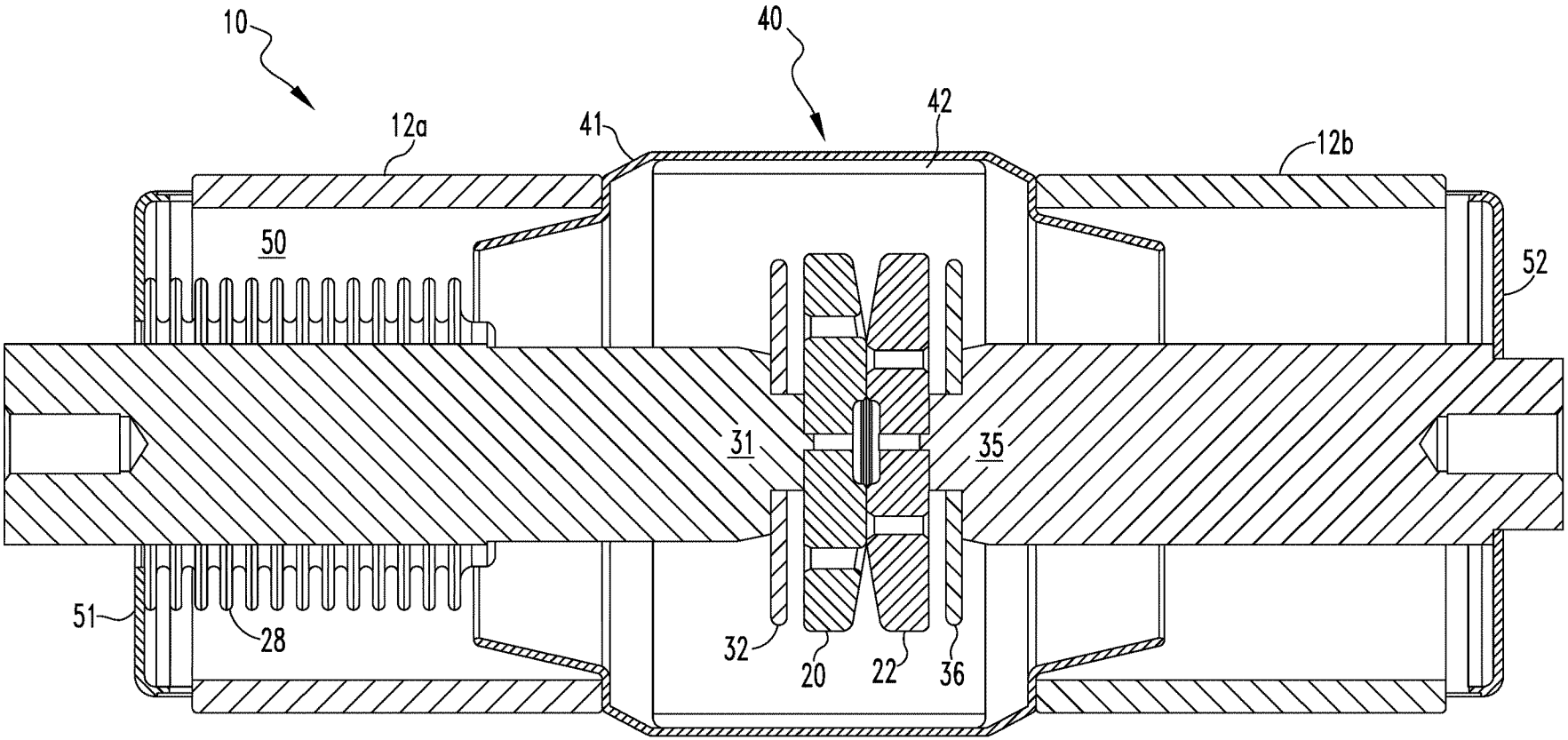
FIG. 1 is a sectional view of a vacuum interrupter including an arc-resistant shield structure, in accordance with certain embodiments of the disclosed concept.

The disclosed concept includes arc-resistant shields, methods for preparing the shields and vacuum interrupters which contain the shields. Vacuum interrupters are key internal components of vacuum switchgear, such as vacuum circuit breakers. Vacuum interrupters generally include a highly-evacuated envelope formed by a casing of suitable insulating material, and a pair of metallic end caps for closing off the ends of the casing. Located within the envelope is a pair of relatively movable contacts, or electrodes. When the contacts are separated there is an arcing gap located therebetween. An arc is established across the gap between the electrodes as the electrodes are opened, and also when they are closed. The arc vaporizes some of the contact material and the vapor is dispersed from the arcing gap towards the envelope. Arc-resistant shields are traditionally positioned within vacuum interrupters and act to intercept and to condense the arc-generated vapor.

Various designs of vacuum interrupters are known in the art. For ease of description, the disclosed concept is described for use with a design commonly referred to as a "belly band". The term "belly band" refers to vacuum interrupters that have a casing formed of ceramic insulating material, an arc-resistant shield, and end caps. The ceramic insulating material can include two ceramic portions separated by an arc-resistant shield. That is, the arc-resistant shield is positioned between a first ceramic portion and a second ceramic portion. The shield and ceramic portions are hermetically sealed. In this design, the arc-resistant shield is not positioned inside the envelope of the vacuum interrupter. Instead, the arc-resistant shield forms a portion of the casing or outer surface of the vacuum interrupter. The belly band interrupter is typically a tubular structure having cylindrical ceramic tube portions and a cylindrical arc-resistant shield tube. It is understood, however, that the disclosed concept is not limited to this type of vacuum interrupter design.

The ceramic insulating material is composed of ceramic or ceramic-containing material such as alumina, zirconia or other oxide ceramics, but may also be glass.

The arc-resistant shield includes a shield structure and an arc-resistant material. The shield structure can be composed of a material or a combination of materials known in the art for use in constructing shield structures for vacuum interrupters, and capable of forming a hermetic seal with the ceramic insulator material. Suitable materials include, but are not limited to, stainless steel, copper, steel, nickel-iron, cupronickel and mixtures thereof. It is preferable, but not required, that the shield structure is in the form of a single continuous sheet.

The arc-resistant material includes a compound or a combination of compounds that are known in the art for use in forming arc-resistant materials. In general, the arc-resistant material is an alloy composition which is capable of demonstrating resistance to arc damage and holding off high voltages after arcing. Copper-chromium alloys are known materials for use with highest fault current ratings because of their resistance to heavy arcing and their ability to preserve the high voltage withstand of the interrupter after arcing has occurred. Preferred copper-chromium alloys include from about 10 to about 60 weight percent chromium or from about 10 to about 25 weight percent chromium and the balance copper based on total weight of the alloy composition. Pure chromium is an expensive element and therefore, it may be preferred that its presence in an alloy composition is as minimal as feasible compared to the presence of copper in the alloy composition to reduce cost. Suitable arc-resistant materials for use in the disclosed concept include, but are not limited to copper, copper-chromium alloy, copper-iron alloy, copper-ferrochrome alloy and mixtures thereof.

In certain embodiments, the arc-resistant material includes copper, e.g., in the form of pure copper and/or copper alloy, and a chromium alloy wherein the chromium alloy is ferrochrome. The amount of each of these components can vary. The ferrochrome may constitute from about 5 to about 60 weight percent based on total weight of the composition. The copper may constitute the balance. The ferrochrome component is a chromium-iron alloy wherein the amount of each of the chromium and iron can vary. The chromium may constitute about 70 weight percent and the iron may constitute about 30 weight percent based on total weight of the ferrochrome component.

In certain embodiments, the arc-resistant material is copper-chromium alloy including about 25 weight percent chromium and the balance copper based on total weight of the alloy composition. Various forms of copper-chromium alloy and processes for manufacturing copper-chromium alloy are known in the art. The form of the copper-chromium alloy and the process employed to manufacture the alloy is not critical to the invention and therefore, suitable copper-chromium alloys for use in the invention may be selected from those that are known in the art and commercially available. For example, Eaton Corporation uses a powder metal process to produce copper-chromium alloy. Other known copper-chromium alloys include those in a cylindrical shape manufactured by processes including vacuum induction melting, extrusion, vacuum induction melting and extrusion, infiltration, infiltration and extrusion, usually with final machining to shape. Other processes may include binder-assisted powder metal extrusion.

In certain embodiments, the arc-resistant material is incorporated into, e.g., co-formed with, the shield structure to form a composite and in other embodiments, the arc-resistant material is applied to or deposited on the surface of the shield structure to form a layer or coating, e.g., thin film, thereon. Non limiting examples of forming the arc-resistant shield include the following:

Co-forming the arc-resistant material and shield structure against a mandrel by use of an isostatic press;

Co-forming the arc-resistant material and shield structure against a mandrel using an uniaxial press with a laterally acting die;

Expanding the arc-resistant material to fit the shield structure by compressing elastomer or expansion hydroforming inside the arc-resistant material and forcing it to conform to the shape of the shield structure;

Forming a powder metal mixture of arc-resistant material including a suitable binder and applying the mixture to a surface of the shield structure and simultaneously sintering the arc-resistant material and sinterbonding the arc-resistant material to the shield structure, wherein the step of applying can be performed by (i) spreading the mixture onto the surface or (ii) forming a tape and applying the tape onto the surface;

Preparing the arc-resistant material, forming the shield structure in two pieces, and attaching the arc-resistant material to a surface of the shield structure and hermetically sealing the two shield portions together, for example, by brazing; and Preparing the arc-resistant material, placing it on a mandrel, then forming the shield structure around the arc-resistant material by metal spinning.

FIG. 1 shows a vacuum interrupter 10 having a first cylindrical ceramic insulating tube 12*a*, a second cylindrical ceramic insulating tube 12*b*, and a cylindrical arc-resistant shield 40 positioned therebetween. The shield 40 includes a metal surface 41 and an arc-resistant material 42 which is formed on the interior surface of the metal surface 41. The metal surface 41 is hermetically sealed to the first and second ceramic insulating tubes 12*a*,12*b*. That is, on one end of the shield 40 the metal surface 41 is hermetically sealed to one end of the first ceramic insulating tube 12*a* and on an opposite end of the shield 40, the metal surface 41 is hermetically sealed to one end of the second ceramic insulating tube 12*b*. The hermetic seal can be provide using a variety of conventional apparatus and techniques known in the art. For example, the hermetic seal can be provided by welding or brazing. Each of the first and second ceramic insulating tubes 12*a*,12*b* are coupled to end seals 51 and 52, respectively. That is, each end of the first and second ceramic insulating tubes 12*a*,12*b* which is not sealed to the shield 40 is coupled to end seals 51 and 52, respectively. A vacuum envelope 50 is formed within the cavity of the vacuum interrupter 10.

In alternate embodiments, the arc-resistant material 42 may or may not extend over the entire surface of the metal surface 41. That is, for example, a portion of the metal surface 41 which is in contact with the first and second ceramic insulating tubes 12*a*,12*b* for the purpose of hermitically sealing, may not include the presence of the arc-resistant material 42, as shown in FIG. 1. In other embodiments, the arc-resistant material 42 may be present over the entire surface of the metal surface 41.

A first electrode assembly 20 and a second electrode assembly 22 are longitudinally aligned within the interior tubular cavity formed by shield 40. The first and second electrode assemblies 20,22 have opposing contact surfaces and are axially movable with respect to each other for opening and closing the AC circuit. The contact surfaces abut one another in a closed circuit position and are separated to open the circuit. An arc is formed between the contact surfaces when the contacts are moved apart to the open circuit position. The arcing continues until the current is interrupted.

Without intending to be bound by any particular theory, it is believed that since the shield 40 extends to the exterior surface of the vacuum interrupter 10 (and is not formed within the cavity of the vacuum interrupter, as is traditional in other designs), there is a larger insulating area formed by the shield 40 which can accommodate larger electrode assemblies 20,22.

The first electrode assembly 20 is connected to a generally cylindrical first terminal post 31 extending out of the vacuum envelope 50 through a hole in the end seal 51 which connects to an AC circuit (not shown). Further, the first electrode assembly 20 includes a bellows 28 mounted thereto which seals the interior of the vacuum envelope 50, while permitting movement of the first electrode assembly 20 from a closed position as shown in FIG. 1 to an open circuit position (not shown). A first vapor condensing shield 32 is mounted on the first terminal post 31.

A second electrode assembly 22 is connected to a generally cylindrical second terminal post 35 extending through an end seal 52. A second vapor condensing shield 36 is mounted on the second terminal post 35. The second terminal post 35 is rigidly and hermetically sealed to the end seal 52 by means such as, but not limited to, welding or brazing.

Metal from the contact surfaces of the first and second electrode assemblies 20,22 that is vaporized by the arc forms a neutral plasma during arcing and condenses back onto the contacts surfaces of the first and second electrode assemblies 20,22 and also onto each of the first and second vapor condensing shields 32 and 36, respectively.

While the vacuum envelope 50 shown in FIG. 1 is part of the vacuum interrupter 10, it is to be understood that the term "vacuum envelope" as used herein is intended to include any sealed component having a ceramic to metal seal which forms a substantially gas-tight enclosure. Such sealed enclosures may be maintained at sub-atmospheric, atmospheric or super-atmospheric pressures during operation.

An arc-resistant shield in accordance with the disclosed concept can be formed using various known processes, such as but not limited to, powder metallurgy, extrusion, forging and casting processes. Traditional powder metallurgy techniques include but are not limited to pressing and sintering, extrusion, e.g., binder-assisted extrusion, powder injection molding and powder forging. Extrusion includes hot or cold extrusion and forging includes hot forging or cold forming. Casting includes vacuum induction melting, sand casting, and other conventional casting methods.

In accordance with certain embodiments of the disclosed concept, a shield structure is obtained and an arc-resistant material is incorporated into the composition of the shield structure or is applied to a surface of the shield structure.

In certain embodiments, the arc-resistant material includes a copper-chromium alloy. The copper and chromium components may be in dry form, e.g., powder. The copper and chromium powders are mixed together to form an alloy mixture. In certain embodiments, the chromium powder can be ferrochrome powder which constitutes a pre-alloyed chromium-iron powder. The copper and chromium powders may be atomized, chemically reduced, electrolytically formed, ground or formed by any other known powder production process. The powder morphology may be spherical, acicular, or irregular. The copper-chromium powder mixture is pressed to shape and sintered. The shaping and sintering can be conducted in accordance with conventional shaping and sintering apparatus and processes known in the art. The shaped, sintered article forms an arc-resistant shield. Optionally, machining of the shaped, sintered article may be necessary to finalize the form of the shield.

EXAMPLES

The following non-limiting examples of the fabrication and use of an arc-resistant shield in accordance with certain embodiments of the disclosed concept are provided.

Example 1

1. A copper-chromium shield sleeve was formed by a powder metal process.
2. The copper-chromium shield sleeve was assembled on a rigid mandrel, tightly fitted, where the mandrel was shaped to the final geometry of the composite arc-resistant shield.
3. Metal tubing was placed around the mandrel and copper-chromium shield sleeve.
4. The assembly was enclosed in a rubber bag.
5. The bagged assembly was placed into an isostatic press and 16,000 psi of pressure was applied to force the metal tubing into shape and lock the copper-chromium shield to the shield.
6. The bagged assembly was removed from the press and the formed shield was removed from the mandrel.
7. The ends of the formed composite arc-resistant shield were machined to a final shape.
8. The vacuum interrupter was assembled by brazing the hermetic outer shield to the insulating ceramics of a vacuum interrupter.

Example 2

1. A copper-chromium shield sleeve was formed by a powder metal process.
2. The copper-chromium shield sleeve was assembled on a rigid mandrel, tightly fitted, where the mandrel was shaped to the final geometry of the composite arc-resistant shield.
3. Metal tubing was placed around the mandrel and copper-chromium shield sleeve.
4. The assembly of mandrel, copper-chromium shield sleeve, and metal tubing were placed inside a press die with laterally acting components that shaped the tubing into the final shield geometry and locked the copper-chromium sleeve in place.
5. The composite shield was formed in the die on a uniaxial press.
6. The composite shield was ejected separate from mandrel, and the ends of the formed shield were machined to a final shape.
7. The vacuum interrupter was assembled by brazing the hermetic outer shield to the insulating ceramics of a vacuum interrupter.

Example 3

1. A cylindrical copper-chromium shield sleeve was formed by a powder metal process.
2. The copper-chromium shield sleeve was assembled inside a metal tube that was to form the outer hermetic shield component.
3. A uniaxial press acting on an internally placed elastomeric plug was used to force the copper-chromium sleeve to expand into the outer hermetic shield component.
4. The ends of the hermetic outer shield were pressed, formed and machined into the final geometry.
5. The vacuum interrupter was assembled by brazing the hermetic outer shield to the insulating ceramics of a vacuum interrupter.

Example 4

1. The outer hermetic shield component was formed by traditional means from oxygen-free copper tubing.
2. A dry powder mixture of 75% copper and 25% chromium metal powder by weight was formed, wherein the copper and chromium powders were both −140 mesh in size, and mixed until homogeneous.
3. Water, poly vinyl alcohol (PVAC)-based adhesive, and methyl alcohol were added to the powder mixture in the proportions of approximately 86% metal powder, 10% water, 2% PVAC, and 2% methyl alcohol by weight, and mixed until a homogeneous paste was formed.

4. The copper-chromium paste was applied as a coating to the inner diameter of the copper shield component and dried until hardened.
5. The outer shield/inner coating assembly was debinded and presintered in a 75%/25% hydrogen/nitrogen atmosphere at 600° C. for 30 minutes.
6. The outer shield/inner coating assembly was vacuum sintered at 1000° C. for 6 hours at a maximum pressure of 3E-4 torr to simultaneously sinter the copper-chromium coating and bond the coating to the outer hermetic shield.
7. The inner copper chromium coating and ends of the copper outer shield were machined to final geometry.
8. The vacuum interrupter was assembled by brazing the hermetic outer shield to the insulating ceramics of a vacuum interrupter.

Example 5

Figure 2:
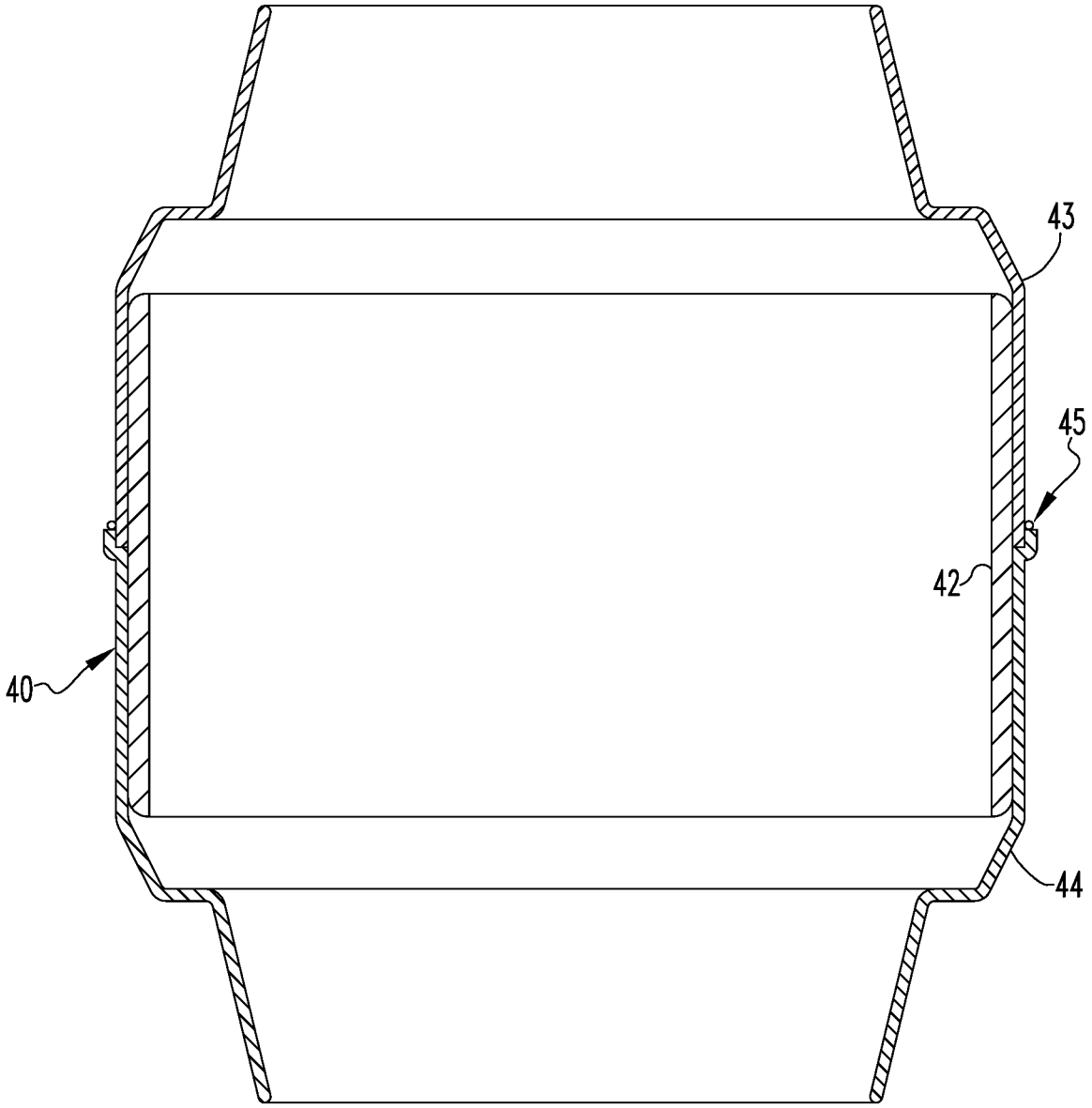
FIG. 2 is a sectional view of an arc-resistant shield structure, in accordance with certain embodiments of the disclosed concept.

1. A powder metal process was used to form a copper-chromium arc-resistant material 42, as shown in FIGS. 1 and 2.
2. In accordance with FIG. 2, an endcap 43 and an endcap 44 were formed with mating end features such that the two pieces fit together and formed a joint 45.
3. The endcaps 43,44 were assembled around the copper-chromium arc-resistant material 42.
4. A brazing or welding process was used to permanently join and hermetically seal the endcaps 43,44 at the joint 45, thus locking the copper-chromium shield within the assembled cylinder and forming the arc-resistant shield 40, as shown in FIGS. 1 and 2.
5. A vacuum interrupter (not shown) was assembled by brazing the hermetic outer shield to the insulating ceramics of a vacuum interrupter.

Example 6

1. A copper-chromium shield sleeve was formed by a powder metal process.
2. The copper-chromium shield sleeve was assembled on a rigid mandrel, tightly fitted, wherein the mandrel was shaped to the final geometry of the composite arc-resistant shield.
3. Metal tubing was placed around the mandrel and copper-chromium shield sleeve.
4. The mandrel, copper-chromium sleeve, and metal tubing were placed onto a lathe suitable for metal spinning.
5. Spinning tools were used to form the outer hermetic shield to the final geometry and the copper-chromium shield was locked against the hermetic outer metal shield.
6. The shaped shield assembly was removed from the mandrel.
7. The vacuum interrupter was assembled by brazing the hermetic outer shield to the insulating ceramics of a vacuum interrupter While example systems, methods, and the like have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the disclosed concept is not limited to the specific details, the representative apparatus, and illustrative examples shown and described. Thus, this application is intended to embrace alterations, modifications, and variations that fall within the scope of the appended claims.

What is claimed is:

1. A method for preparing a vacuum interrupter, comprising:

forming a tubular vacuum cavity, comprising:
- a first ceramic portion;
- a second ceramic portion; and
- an arc-resistant shield, comprising:
  - a shield structure having an interior surface, an exterior surface, a first end and an opposite second end; and
  - an arc-resistant material, comprising:
    - copper-chromium alloy, comprising:
      - copper selected from the group consisting of pure copper and copper alloy; and
      - chromium alloy comprising ferrochrome, wherein the arc-resistant material is applied to at least a portion of the interior surface of the shield structure to form a layer, or wherein the arc-resistant material is co-formed with the shield structure to form a composite;
- a first electrode assembly; and
- a second electrode assembly;

positioning the arc-resistant shield between the first and second ceramic portions;

hermetically sealing the first end of the shield structure to the first ceramic portion;

hermetically sealing the opposite second end of the shield structure to the second ceramic portion; and positioning the first and second electrode assemblies within a portion of the cavity defined by the arc-resistant shield, said first and second electrode assemblies being separable to establish arcing.

2. The method of claim 1, wherein the hermetically sealing includes brazing or welding.

3. The method of claim 1, wherein the arc-resistant material and shield structure are co-formed against a mandrel utilizing a technique selected from the group consisting of isostatic press, uniaxial press and metal spinning.

4. The method of claim 1, wherein the arc-resistant material is expanded into the shield structure utilizing an uniaxial press acting on an internally placed elastomeric plug.

5. The method of claim 1, wherein the arc-resistant material is in a powder alloy form and is mixed with a suitable binder to form a coating and the coating is applied to the interior surface of the shield structure.

6. The method of claim 5, further comprising sintering and sinterbonding the arc-resistant material to the shield structure.

7. The method of claim 1, wherein the arc-resistant material is in a powder alloy form and is mixed with a suitable binder to form a tape and the tape is applied to the interior surface of the shield structure.

8. The method of claim 1, wherein the arc-resistant material is encased within a multi-piece shield structure.

9. The method of claim 8, wherein the encasement process comprises brazing or welding.

* * * * *